United States Patent [19]

Bryant

[11] 4,094,488

[45] June 13, 1978

[54] HANGER FOR TENNIS RACKETS

[76] Inventor: Neil Bryant, 2800 Crouchwood, Little Rock, Ark. 72207

[21] Appl. No.: 822,803

[22] Filed: Aug. 8, 1977

[51] Int. Cl.[2] ..... A47G 29/00

[52] U.S. Cl. ..... 248/359; 248/340; 248/305; 248/316 C

[58] Field of Search ..... 248/359, 339, 340, 341, 248/309, 316 R, 316 C, 316 D, 304, 305; 24/84 R; 211/113, 13, 14; 273/74; 223/91, 96

[56] References Cited

U.S. PATENT DOCUMENTS

| | | | |
|---|---|---|---|
| 1,203,786 | 11/1916 | Ricords | 273/74 |
| 1,204,618 | 11/1916 | Verkler | 223/62 |
| 1,403,707 | 1/1922 | Quarnstrom | 248/359 |
| 2,212,049 | 8/1940 | Ryland et al. | 248/359 |
| 3,378,222 | 4/1968 | Erickson | 248/359 |
| 3,516,126 | 6/1970 | Berkovits | 24/84 R |

*Primary Examiner*—Robert A. Hafer

*Attorney, Agent, or Firm*—Hill, Gross, Simpson, Van Santen, Steadman, Chiara & Simpson

[57] ABSTRACT

A hanger for any string-type game racket such as a tennis racket has a body member which conforms to and engages an upper, curved edge of the frame about the face, opposite the handle end of the racket. An open, clothes-hanger type hook attached to the upper end of the body permits hanging the racket in a conventional clothes closet on a rod therein, whereby the racket is safely stored while occupying a minimum of useful space. The racket is attached to the body by any convenient means such as pressure sensitive or contact adhering tape, for example, flexible straps of synthetic two-part tape, the parts of the tape being attached to the hanger body and engaging and removably adhering to one another to capture the racket therein, either engaging one another through the openings between the strings of the racket or by one of the tapes passing through the frame among the strings and to an opposite side of the body.

6 Claims, 4 Drawing Figures

HANGER FOR TENNIS RACKETS

BACKGROUND OF THE INVENTION

1. Field of the Invention

The present invention relates to storage devices for strung rackets such as tennis rackets, especially to means for hanging them vertically in a garment storage space.

2. The Prior Art

Tennis and other rackets having strung faces within a generally oval frame have generally been carefully pressed in wooden and other encasing devices for preventing them from warping, as in U.S. Pat. Nos. 1,437,378 and 2,168,119. When such rackets are to be stored, storage racks have been provided as in U.S. Pat. No. 415,342 having press bars therein. A combined storage and carrying case and press is shown in U.S. Pat. No. 1,027,786. New materials such as aluminum, steel, and other metals and composition materials such as fiberglass and carbon fibers have recently come to be employed in tennis rackets in place of laminated wood framing, dispensing with the need for wooden or other presses for clamping the racket frame into a flat position between uses. Such rackets are commonly stored simply in weather-protective canvas and similar bags.

No convenient means of storing such rackets has, to the inventor's knowledge, ever appeared. Rackets are laid flat on a shelf, propped against a wall, hung over a nail or other small hook driven into a closet wall or other sporting goods storage area of the home. Although storage by hanging in a closet on the closet rod would appear to be a simple and straight forward expedient, no suitable device appears to have been developed or made commercially available. Conventional garment hangers and accessory clips, as in U.S. Pat. Nos. 2,211,998, 2,675,148, 2,898,024, and 3,455,491 are generally not adaptable for use with articles other than clothing.

SUMMARY OF THE INVENTION

A hanger for a racket having netting stretched in a frame allows the racket to be hung in a clothes closet from a conventional rod therein, with or without use of a supplemental racket press. The hanger has an open hook placeable over the rod. A body carried by the hook is curved to closely overlie and conform to the top edge of the frame of the racket. One or moe flexible straps attached to the hanger body in one embodiment pass among the racket strings to engage the opposite side of the body. In another embodiment, pairs of opposed straps affixed to the body engage one another through the strings of the racket. In either case, the flexible straps may comprise two-part synthetic sheet-form materials removably adhesive to one another, such as Velcro-brand tape having hooks and eyelets.

THE DRAWINGS

THE PREFERRED EMBODIMENTS

Figure 1:
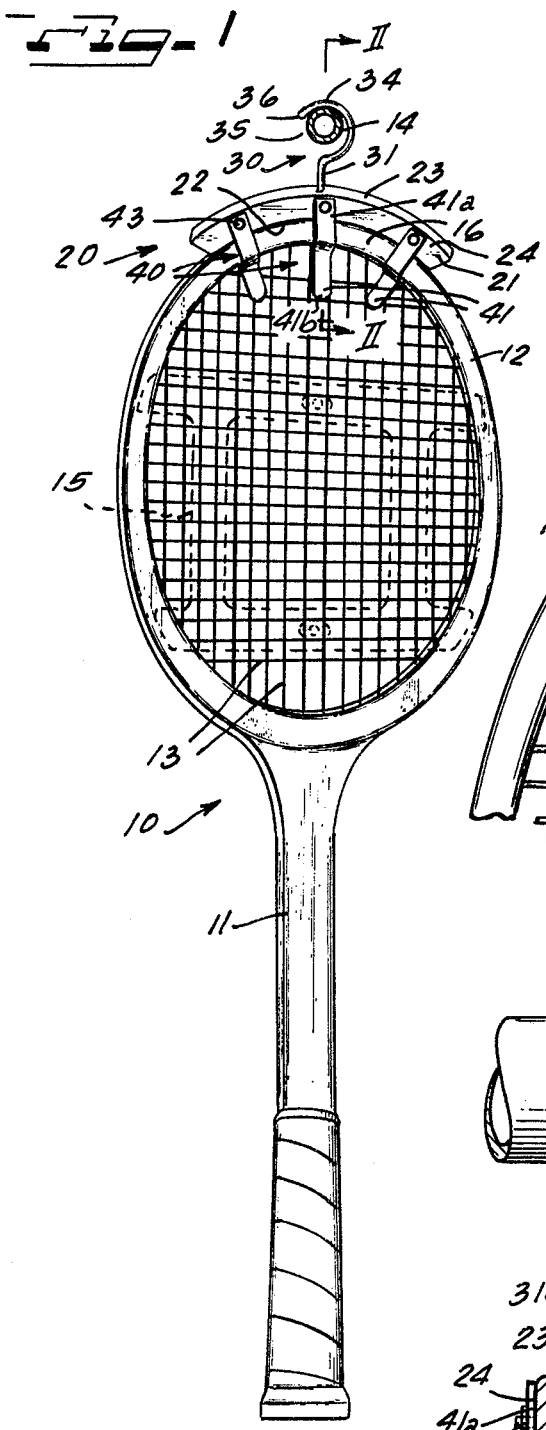
FIG. 1 is a perspective view of a tennis racket and hanger in accordance with the invention, in one embodiment.
Figure 3:
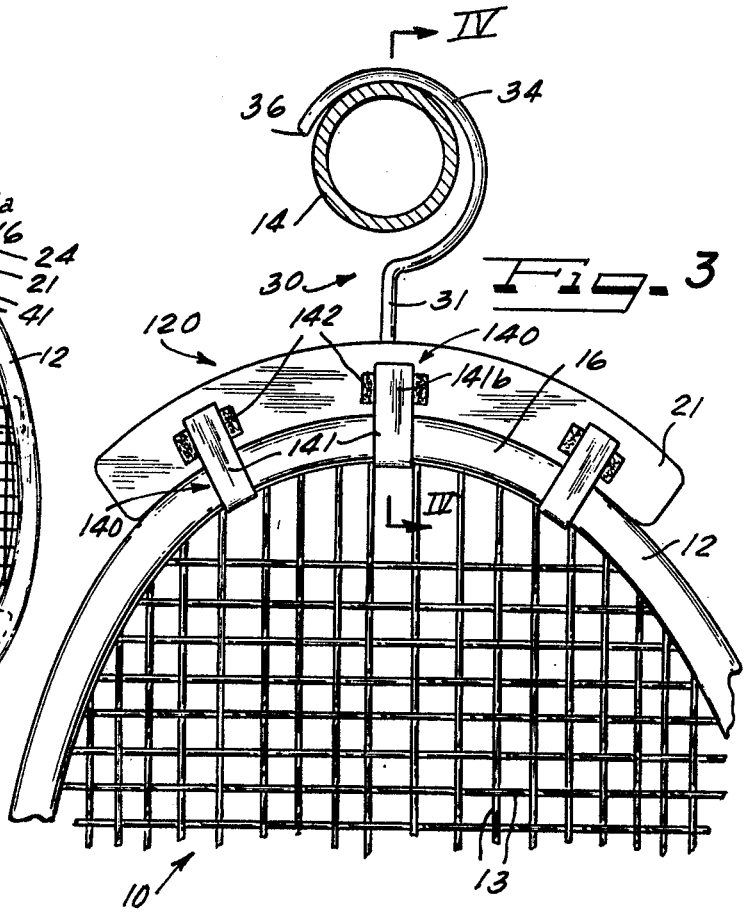
FIG. 3 is a plan view of a second embodiment of the invention in enlarged detail.

A tennis racket 10 having a handle 11 and a generally oval frame 12 which is strung tautly with strings 13 in a top to bottom and side to side, spaced network is adapted for hanging storage in a closet from a closet rod 14 having ends abutting against walls of the closet. The frame 12 of the racket 10 may be comprised of any materials such as laminated wood or metal or modern fiber materials. If the frame 12 is subject to warpage, a press such as that of Holmes U.S. Pat. No. 1,437,378 may be placed over the frame 12, as shown in phantom at 15 in FIG. 1. An upper edge of the top part 16 of the frame 12 is arcuately curved as a part of the oval configuration of the frame 12.

In accordance with the principles of the invention, a racket hanger 20 comprises a body member 21 having a lower edge 22 which is arcuately curved or otherwise structured to conform at least substantially to the curve of the upper portion 16 of the frame 12 of the racket 10. The hanger body 21 further has an outer edge 23 and first and second opposite side walls 24 and 25. The hanger body 21 may be made of wood, metal, or any convenient plastic material.

A hook 30 having a shank 31 and a head 32 is received through the hanger body 21 at an aperture 33 in a center portion thereof. An open jaw 34 on the upper end of the shank 31 has a diameter sufficient to overlie the closet rod 14 and an opening 35 between a terminal end 36 of the jaw 34 and the shank 31 sufficient to pass the closet rod 14 thereinto. The hook member 30 may be made of any convenient material such as wire, and may be affixed in or to the hanger body 21 by any convenient means in addition to or in substitution for that shown.

Further in accordance with the invention, the hanger body 21 has one or more flexible straps 40 attached thereto which may be pressure sensitive or contact adhering. In body exemplary embodiments disclosed herein, each flexible strap comprises one part of a two-part synthetic sheet-form material. The carrier sheet is faced with a material which adheres removably to the other correspondingly faced part thereof when the parts are pressed facially together. A preferred and readily available material is Velcro-brand hook and eyelet tape, with hooks formed on one tape and the eyelets formed on the other from a material such as nylon. When the tapes are pressed together, the hooks on the one tape engage into the eyelets on the other, to connect the tapes together until a sufficient force is applied between them to bend the hooks and disengage them from the eyelets. The Velcro-brand tape is a woven material which is quite flexible.

Figure 2:
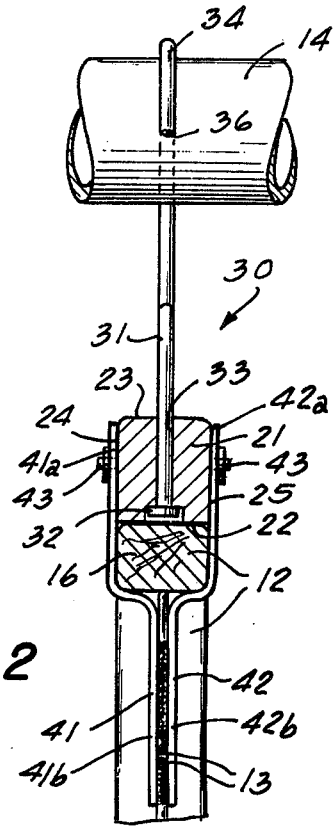
FIG. 2 is a side, sectional view, taken on line II—II of FIG. 1.
Figure 4:
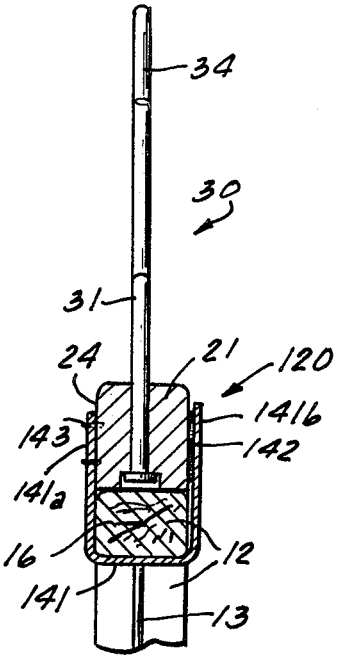
FIG. 4 is a side sectional view, taken on line IV—IV of FIG. 3.

In the first embodiment, shown in FIGS. 1 and 2, a pair of flexible straps 40 are employed, comprising first parts 41 and second parts 42 of the two-part adhesive material. The first strap 41 is attached at one end **41*a* thereof to the first side 24 of the hanger body 21 as by a rivet 43 or other convenient means, such as a staple or adhesive. An opposite end 41*b* is free and extends over the face of the racket. The second part 42 of the two-part adhesive system is attached to the opposite side wall 25 of the hanger body 21 by a similar staple or a rivet 43, in a position to align its free end 42*b* with that of the opposite strap 41 as shown in FIGS. 1 and 2. Of course, the straps 41 and 42 may each be attached to the top or bottom edges 23, 22 of the hanger body 21** without loss of function.

Ends 41*b* and 42*b*, which are free and opposite to the secured ends 41*a* and 42*a* are passed downwardly about the upper part 16 of the frame 12 and are pressed together about the strings 13 in the racket face. Once the tape ends 41*b* and 42*b* are secured together in one or more places about the top end 16 of the frame 12, the racket 10 may be conveniently hung in a closet upon the closet rod 14 therein, occupying substantially only the width or thickness of the frame 12 and handle 11 of the racket 10.

In a second embodiment of the invention, the hanger 120 comprises the body 21 and the hook 30 substantially as in FIGS. 1 and 2. However, the flexible straps 140 comprise at least one single strap 141 secured at one end 141*a* to one side wall 24 of the hanger body 21 as by staples 143. An opposite, free end 141*b* of the strap 141 passes between the strings 13 of the racket 10 and engages a pad 142 of the second part of the synthetic adhesive material which is affixed in alignment with the strap 141 to the body 21. In this embodiment, no material such as the strings 13 is interposed between the adhesive parts 141 and 142, resulting in stronger bond. However, the necessity of threading the straps 141 through the face of the racket 10 is a slight inconvenience in comparison to the first embodiment. Again, the strap 141 may be placed on any of the surfaces of the hanger body 21 and the pad 142 on any of such surfaces which are accessible for use.

In either of the embodiments, one, two, three, or more of the straps 40 or 140 may be employed, since the arcuate curve or similar structure of the body 21 keeps the racket aligned with the hanger. Also, other mechanical attachments such as snaps or buttons may be used to joint or affix the free ends 41*b*, 42*b* of the straps 40 together or to join the strap end 141*b* to the pad 142.

Although these and various other minor modifications may be suggested by those versed in the art, it should be understood that I wish to embody within the scope of the present warranted hereon all such modifications as reasonably and properly come within the scope of my contribution to the art.

I claim as my invention:

1. An article for hanging a game racket in a clothes closet on a horizontal bar therein, the racket having a curved frame with an open face across which strings are tautly strung at spaced intervals, the article comprising:

a body having upper and lower edges and opposite side walls therebetween, the lower edge of the body having surfaces conforming to an upper, outer portion of the racket frame;

an open hook affixed to the upper side of the body and extending upwardly therefrom for engaging over said bar of said closet; and at least one flexible strap member affixed to one of the walls and edges of the body and having means thereon for removably engaging one of the frame and face of the racket, the said flexible strap and engagement means thereon comprise one part of a two-part synthetic sheet-form material, the parts of which are removably adhesvie to one another upon pressing, facial contact together; and a second flexible strap comprising a second part of said two-part tape material is affixed to the body in alignment with the first strap along the face of the racket, for engagement with the racket face and the first strap through the racket face.

2. An article as defined in claim 1, wherein the flexible straps comprise cooperable hook and eyelet tapes.

3. An article for hanging a game racket in a clothes closet on a horizontal bar therein, the racket having a curved frame with an open face across which strings are tautly strung at spaced intervals, the article comprising:

a body having upper and lower edges and opposite side walls therebetween, the lower edge of the body having surfaces conforming to an upper, outer portion of the racket frame;

an open hook affixed to the upper side of the body and extending upwardly therefrom for engaging over said bar of said closet; and at least one flexible strap member affixed to one of the walls and edges of the body and having means thereon for removably engaging one of the frame and face of the racket, the said flexible strap and engagement means thereon comprise one part of a two-part synthetic sheet-form material, the parts of which are removably adhesive to one another upon pressing, facial contact together; and a pad segment comprised of the second part of said two-part material is affixed to the body in alignment with the first strap for engagement with a free end of the strap after same has passed through the face of the racket.

4. For use with a tennis racket of the type comprising a light bat having a netting stretched in a more or less oval frame, the improvement of a hanger comprising:

a main body portion curved to conformably engage the outer adjoining surface of the racket frame;

tie means connected to said body portion and extending downwardly and adapted to pass through the netting and around the adjoining frame to fasten the body portion of the hanger in firm assembly with the racket; and said body portion having upwardly extending retainer means for suspending the hanger and the racket fastened thereto in a suitable storage position, said tie means comprising straps faced with Velcro brand patches.

5. The invention of claim 4, wherein said retainer means comprise a wire-form hook shaped member.

6. For use with a tennis racket of the type comprising a light bat having a netting stretched in a more or less oval frame, the improvement of a hanger comprising:

a main body portion curved to conformably engage the outer adjoining surface of the racket frame;

tie means connected to said body portion and extending downwardly and adapted to pass through the netting and around the adjoining frame to fasten the body portion of the hanger in firm assembly with the racket; and said body portion having upwardly extending retainer means for suspending the hanger and the racket fastened thereto in a suitable storage position;

said tie means comprising flexible straps having cooperable hook and eyelet snaps.

* * * * *